US006204611B1

(12) United States Patent
Bouwman et al.

(10) Patent No.: US 6,204,611 B1
(45) Date of Patent: Mar. 20, 2001

(54) PULSE IGNITION APPARATUS FOR A DISCHARGE LAMP

(75) Inventors: Lambertus J. M. Bouwman, Eindhoven; Arjan Van Den Berg, Nijmegen, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/390,843

(22) Filed: Sep. 7, 1999

(30) Foreign Application Priority Data

Sep. 7, 1998 (EP) ..... 98202987

(51) Int. Cl.[7] ..... H05B 41/23

(52) U.S. Cl. ..... 315/290; 315/209 R; 315/219; 315/276; 315/DIG. 5; 315/DIG. 7

(58) Field of Search ..... 315/290, 209 R, 315/219, 224, 276, 291, 307, DIG. 5, DIG. 7

(56) References Cited

U.S. PATENT DOCUMENTS

| | | | | |
|---|---|---|---|---|
| 3,818,253 | * | 6/1974 | Chafer et al. | 315/209 R |
| 4,342,948 | * | 8/1982 | Samuels | 315/290 |
| 5,621,278 | * | 4/1997 | Chambers | 315/219 |
| 5,783,908 | * | 7/1998 | Toda et al. | 315/224 |
| 5,821,681 | * | 10/1998 | Wynn | 313/318.01 |
| 5,962,985 | * | 10/1999 | Buij et al. | 315/224 |
| 6,008,591 | * | 12/1999 | Huber et al. | 315/219 |

* cited by examiner

*Primary Examiner*—Don Wong
*Assistant Examiner*—Thuy Vinh Tran
(74) *Attorney, Agent, or Firm*—Bernard Franzblau

(57) ABSTRACT

A pulse igniter for a discharge lamp has a transformer with a primary winding coupled to a first capacitor and a switching element and a secondary winding shunted by a series circuit of a diode and a second capacitor at its output. As a result, the generated ignition voltage is rectified and applied to the lamp for a relatively long time interval, resulting in improved ignition behavior.

20 Claims, 2 Drawing Sheets

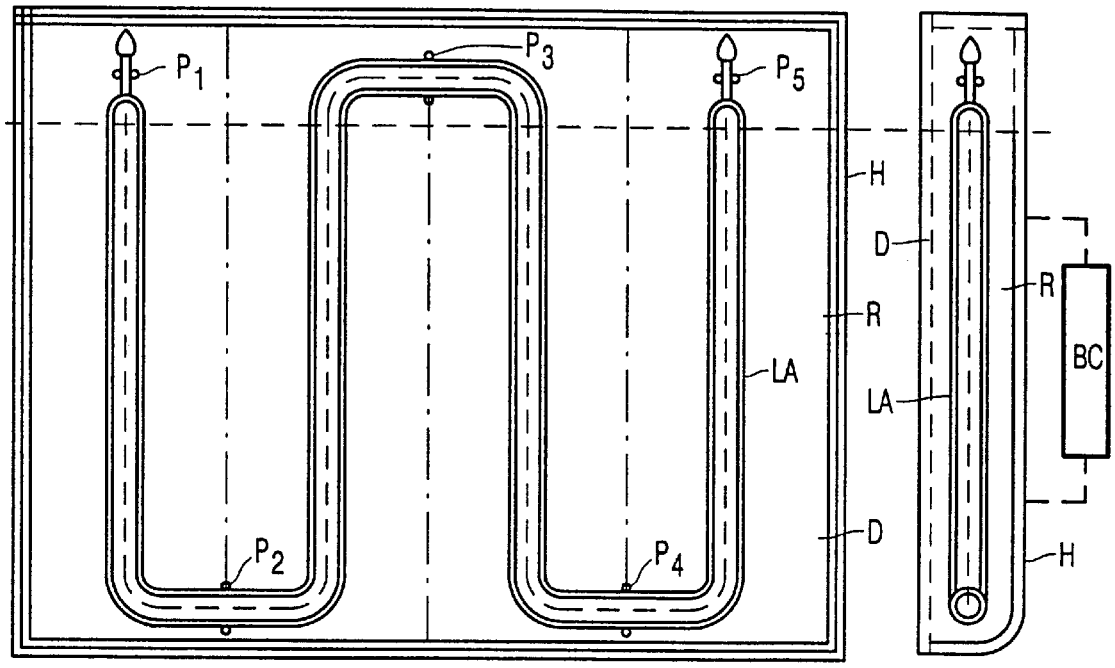
FIG. 2a
FIG. 2b
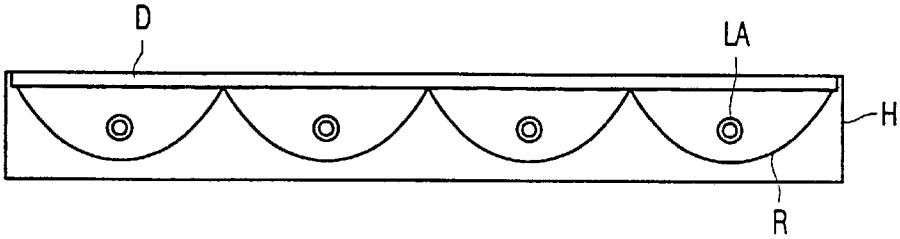
FIG. 3

PULSE IGNITION APPARATUS FOR A DISCHARGE LAMP

BACKGROUND OF THE INVENTION

This invention relates to a circuit arrangement for igniting a lamp, comprising input terminals for connection to a power supply source, a first capacitive element, a first circuit component coupled to the first capacitive element and to the input terminals for generating a charging current from a power supply voltage supplied by the power supply source, said charging current being used for charging the first capacitive element a transformer having a primary winding and a secondary winding, a first branch shunting the first capacitive element and comprising a series arrangement of the primary winding and a switching element, output terminals coupled to the secondary winding for connecting a load circuit comprising a lamp.

The invention also relates to an illumination unit.

A circuit arrangement as described in the opening paragraph is known from U.S. Pat. No. 4,342,948. The known circuit arrangement is very suitable for generating a voltage having a relatively high amplitude. In practice, it is often found for such a circuit arrangement that the voltage generated by the circuit arrangement has the shape of an attenuated AC voltage because the leakage inductance of the transformer resonates with the first capacitive element. The frequency of the attenuated AC voltage is often relatively high. Since the transport of charge carriers in the ignited lamp is relatively slow, the relatively high frequency of the attenuated AC voltage has the result that the maximum amplitude of the ignition voltage of the lamp is higher than the maximum amplitude of the attenuated AC voltage across the second capacitive element. The ignition behavior of the lamp is thereby influenced positively. A drawback of the relatively high frequency of the attenuated AC voltage is, however, that the ignition voltage is present across the lamp only for a relatively short time. The frequency of the attenuated AC voltage can be modified by modifying the dimensioning of the circuit arrangement. However, the latter would result in a relatively expensive and voluminous circuit arrangement. In practice, the relatively high frequency of the attenuated AC voltage has the result that some lamps do not ignite or only ignite after a relatively large number of attempts.

SUMMARY OF THE INVENTION

It is an object of the invention to provide a circuit arrangement for igniting a lamp, with which the lamp can be ignited rapidly and effectively.

According to the invention, a circuit arrangement as described in the opening paragraph is therefore characterized in that the secondary winding is shunted by a second branch comprising a series arrangement of a unidirectional element and a second capacitive element.

During operation of the circuit arrangement, the second capacitive element is charged to a voltage which is equal to the maximum amplitude of the attenuated AC voltage which would be present across the second capacitive element in the absence of the unidirectional element. However, due to the presence of the unidirectional element, the voltage across the second capacitive element in a circuit arrangement according to the invention is a DC voltage instead of an attenuated AC voltage. In theory, an infinitely long voltage pulse is present across the second capacitive element. The DC voltage across the second capacitive element also constitutes the ignition voltage across the lamp. In practice, the voltage across the second capacitive element decreases because it is discharged by means of the leakage current of the unidirectional element and the leakage current of the second capacitive element. Although the maximum amplitude of the ignition voltage across the lamp which is generated by a circuit arrangement according to the invention is relatively low, the period of time during which this ignition voltage is present across the lamp is relatively long. It has been found that lamps of various types and power can be ignited rapidly and effectively by means of the circuit arrangement according to the invention.

The switching element may be constituted by a breakdown element which becomes conducting at a given value of the voltage across the first capacitive element. However, it has proved to be advantageous to make use of a switching element provided with a control electrode and to provide the circuit arrangement with a control circuit coupled to the control electrode for rendering the switching element conducting and non-conducting. A very reliable operation of the circuit arrangement can be realized in this way. More particularly, this has been found for embodiments of a circuit arrangement according to the invention in which the switching element is a thyristor. It has also been found that a good control of the conductivity state of the switching element is possible when the control circuit comprises a diac and/or a zener diode.

The unidirectional element preferably comprises a diode.

In a preferred embodiment of a circuit arrangement according to the invention, the output terminals are connected by means of a third branch comprising a series arrangement of the second capacitive element and the input terminals. The ignition voltage across the lamp is thus formed by the sum of the power supply voltage and the voltage across the second capacitive element.

A circuit arrangement according to the invention is very suitable for igniting a discharge lamp having a filling which mainly consists of neon. A discharge lamp having a filling which mainly consists of neon is herein understood to mean a discharge lamp having a filling comprising neon in such a way that red light is generated in the plasma of the lamp during stationary lamp operation, with the color point in the C.I.E. chromaticity diagram being in the range bounded by the lines $y=0.300$, $y=0.350$, $y=-x+1$ and $y=-x+0.99$. Such a lamp is very suitable for use in an illumination unit used, for example, as a signal light in a motorcar. Such an illumination unit is preferably provided with a housing having a reflecting surface and with means for positioning the lamp in the housing. If the illumination unit is not used as a brake light but, for example, as a blinker, the wall of the lamp is preferably provided with a luminescent coating.

BRIEF DESCRIPTION OF THE DRAWING

These and other aspects of the invention will come apparent from and will be elucidated with reference to the embodiments described hereinafter.

In the drawings:

FIG. 2 shows diagrammatically an embodiment of an illumination unit according to the invention.

FIG. 3 shows a cross-section of the illumination unit.

DESCRIPTION OF THE PREFERRED EMBODIMENTS

Figure 1:
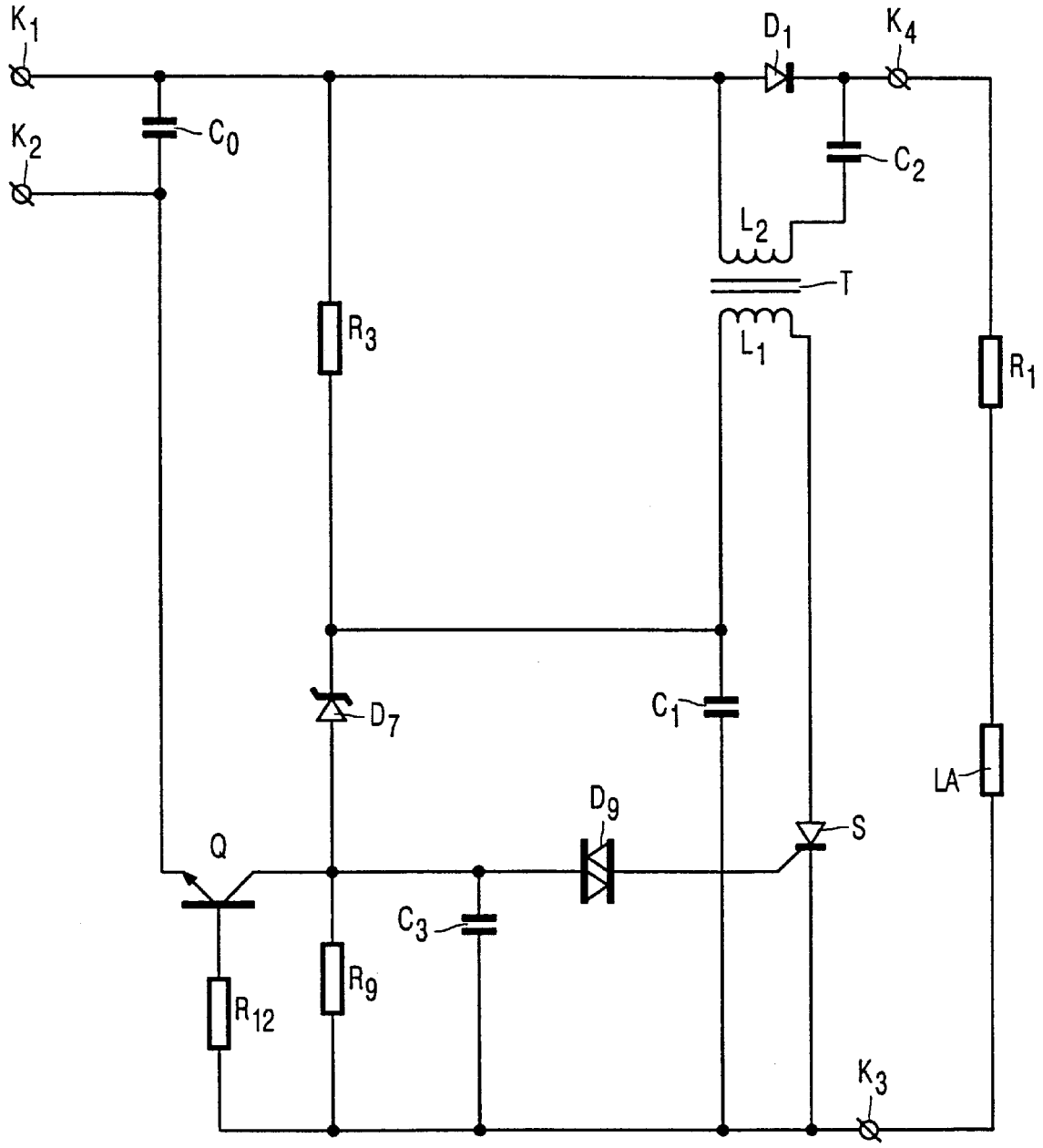
FIG. 1 shows diagrammatically an embodiment of a circuit arrangement according to the invention, with a load circuit comprising a lamp connected thereto.

In FIG. 1, the references K1 and K2 denote input terminals for connection to a power supply source. Input terminals K1 and K2 are interconnected by means of capacitor C0. Capacitor C0 is shunted by a series arrangement of an ohmic resistor R3, a zener diode D7 and a transistor Q. A common point of zener diode D7 and transistor Q is connected to a base electrode of transistor Q via a series arrangement of ohmic resistors R9 and R12. The series arrangement of zener diode D7 and ohmic resistor R9 is shunted by a capacitor C1 which constitutes a first capacitive element in this embodiment. Ohmic resistor R9 is shunted by a capacitor C3. A common point of capacitor C3 and ohmic resistor R9 is connected to a first end of diac D9, and a further end of diac D9 is connected to a control electrode of thyristor S, which constitutes a switching element in this embodiment. Capacitor C1 is shunted by a series arrangement of primary winding L1 of transformer T and thyristor S which together constitute a first branch. A common point of capacitor C1 and thyristor S is connected to output terminal K3. Input terminal K1 is connected to output terminal K4 via diode D1. Output terminals K3 and K4 are connected by means of a series arrangement of an ohmic resistor R1 and a discharge lamp LA, which series arrangement constitutes a load circuit in this embodiment. Ohmic resistor R1 constitutes a stabilizing element for limiting the current through the discharge lamp LA. In this embodiment, diode D1 constitutes a unidirectional element. Diode D1 is shunted by a series arrangement of secondary winding L2 of transformer T and capacitor C2 which constitutes a second capacitive element in this embodiment. Diode D1 and capacitor C2 jointly constitute a second branch. R3 constitutes a first circuit component coupled to the first capacitive element and to the input terminals for generating a charging current from a power supply voltage supplied by the power supply source, which charging current is used for charging the first capacitive element. Ohmic resistors R3 and R9, zener diode D7, diac D9 and capacitors C1 and C3 jointly constitute a control circuit coupled to the control electrode of the switching element for rendering the switching element conducting and non-conducting. The series arrangement of capacitor C2, secondary winding L2, input terminal K1, capacitor C0 and input terminal K2 constitutes a third branch in this embodiment.

The embodiment shown in FIG. 1 operates as follows.

If input terminals K1 and K2 are connected to a power supply source supplying a DC voltage, capacitor C1 is charged via resistor R3 to the zener voltage of zener diode D7. After zener diode D7 has become conducting, capacitor C3 is charged via ohmic resistor R3 and zener diode D7 until the breakdown voltage of diac D9 is reached. When diac D9 becomes conducting, a current flows through the control electrode of thyristor S and thyristor S also becomes conducting. Capacitor C1 is subsequently discharged via primary winding L1 and thyristor S. Consequently, a voltage is generated between the ends of the secondary winding L2, so that capacitor C2 is charged to a DC voltage. Before the discharge lamp LA ignites, a DC voltage is present across the discharge lamp LA, which is equal to the sum of the power supply voltage and the voltage across capacitor C2. If the discharge lamp LA ignites, a current flows from input terminal K1 to input terminal K2 via diode D1, output terminal K4, ohmic resistor R1, discharge lamp LA, output terminal K3, resistor R12 and the base-emitter junction of transistor Q. Due to this current, transistor Q becomes conducting so that capacitor C3 is prevented from being charged to the breakdown voltage of diac D9, so that no ignition voltage is generated anymore.

FIG. 2*a* in FIG. 2 is a front-elevational view of an illumination unit according to the invention. FIG. 2*b* is a side-elevational view of the same illumination unit. LA is a bent discharge lamp provided with a plasma which consists of neon. The wall of the discharge lamp has a luminescent coating. H constitutes a housing having a rectangular opening. The housing accommodates a mirror reflector R which constitutes the reflecting surface in this embodiment. The rectangular opening of the housing is closed by means of a light-transmissive lid D. In this embodiment, pins P1–P5 constitute means for positioning the discharge lamp in the housing. In FIG. 2*b,* the reference BC denotes an embodiment of a circuit arrangement according to the invention. The coupling between circuit arrangement BC and the lamp LA is shown diagrammatically by means of broken lines. FIG. 2*c* is a cross-section of the illumination unit in accordance with FIG. 2*a* and FIG. 2*b* through the broken line shown in FIGS. 2*a* and 2*b* and perpendicular to the plane in which the discharge lamp LA is bent.

What is claimed is:

1. A circuit arrangement for igniting a discharge lamp, comprising:

input terminals for connection to a power supply source, a first capacitive element, a first circuit component coupled to the first capacitive element and to the input terminals for generating a charging current for charging the first capacitive element from a power supply voltage supplied by the power supply source, a transformer having a primary winding and a secondary winding, a first branch shunting the first capacitive element and comprising a series arrangement of the primary winding and a switching element, output terminals coupled to the secondary winding for connecting a load circuit comprising the discharge lamp, characterized in that the secondary winding is shunted by a second branch comprising a series arrangement of a unidirectional element and a second capacitive element.

2. A circuit arrangement as claimed in claim 1, wherein the switching element has a control electrode and the circuit arrangement includes a control circuit coupled to the control electrode for rendering the switching element conducting and non-conducting.

3. A circuit arrangement as claimed in claim 1, wherein the unidirectional element comprises a diode polarized so as to charge the second capacitive element via the diode when the switching element is made to conduct.

4. A circuit arrangement as claimed in claim 1, wherein the switching element is a thyristor.

5. A circuit arrangement as claimed in claim 2, wherein the control circuit comprises a diac coupled to the first circuit component via a voltage breakdown element.

6. A circuit arrangement as claimed in claim 2, wherein the control circuit comprises a zener diode connected in series with the first circuit component and in parallel with the first capacitive element.

7. A circuit arrangement as claimed in claim 1, wherein the output terminals are connected by means of a third branch comprising a series arrangement of the second capacitive element and the input terminals.

8. An illumination unit comprising a circuit arrangement as claimed in claim 1, and a discharge lamp coupled to the output terminals of the circuit arrangement via a ballast impedance.

9. An illumination unit as claimed in claim 8, wherein the filling of the discharge lamp mainly consists of neon.

10. An illumination unit as claimed in claim 8, comprising a housing having a reflecting surface and with means for positioning the discharge lamp in the housing.

11. A circuit for igniting a discharge lamp comprising:

first and second input terminals for connection to a source of DC supply voltage for the circuit, a first capacitor, a first circuit component coupling the first capacitor to the first and second input terminals so as to provide a charge path for the first capacitor from a DC supply voltage applied to the input terminals, a transformer having a primary winding and a secondary winding, a switching element connected in a first series circuit with the transformer primary winding across the first capacitor so as to discharge the first capacitor via the primary winding and the switching element when the switching element is conductive, a second series circuit including a unidirectional element and a second capacitor connected in shunt with the transformer secondary winding and with the unidirectional element polarized with respect to the transformer windings so as to provide a charge path for the second capacitor for a current induced in the secondary winding when the switching element is conductive, and first and second output terminals coupled to the transformer secondary winding for connection of a load circuit including the discharge lamp.

12. The lamp igniting circuit as claimed in claim 11 wherein the switching element has a control electrode coupled to a control circuit for controlling the switching of the switching element.

13. The lamp igniting circuit as claimed in claim 12 wherein the control circuit comprises;

a third capacitor coupled to at least one input terminal via the first circuit component and to the control electrode of the switching element via a first breakdown element, said third capacitor and first voltage breakdown element being operative to trigger the switching element into conduction.

14. The lamp igniting circuit as claimed in claim 13 further comprising a transistor switch coupling the third capacitor to the other one of the input terminals, said transistor being connected in the circuit so as to conduct a current when a connected discharge lamp is in a stable operation condition thereby to limit the voltage on the third capacitor to a level below the voltage breakdown value of the first voltage breakdown element, which prevents triggering of the switching element into conduction during stable operation of a connected discharge lamp.

15. The lamp igniting circuit as claimed in claim 13 further comprising a second voltage breakdown element connected in a series circuit with the first circuit component and the third capacitor to the input terminals thereby to provide a time delayed charge path for the third capacitor.

16. The lamp igniting circuit as claimed in claim 15 further comprising a transistor switch controlled by current flow through a connected discharge lamp and operative when the transistor switch is conductive to limit the voltage across the third capacitor to a voltage level below the breakdown voltage of the first voltage breakdown element.

17. The lamp igniting circuit as claimed in claim 16 wherein the first voltage breakdown element is a diac, the second voltage breakdown element is a zener diode, and the first circuit component is a resistor.

18. The lamp igniting circuit as claimed in claim 13 further comprising a second voltage breakdown element connected in a series circuit with the first circuit component and the third capacitor to the input terminals, and means connecting the first capacitor to a circuit point between the first circuit component and the second voltage breakdown element.

19. The lamp igniting circuit as claimed in claim 11 wherein the second series circuit comprising the unidirectional element and the second capacitor is operative to stretch out the time in which an ignition pulse generated via the transformer windings is applied to the output terminals.

20. The lamp igniting circuit as claimed in claim 11 wherein a load circuit including a discharge lamp and a series connected ballast element is connected to said output terminals.

* * * * *